US006727006B2

(12) United States Patent
Kramski

(10) Patent No.: US 6,727,006 B2
(45) Date of Patent: Apr. 27, 2004

(54) METHOD FOR PRODUCTION AND/OR PROCESSING OF PLUG PARTS IN FOLLOW-ON COMPOSITE TOOLS

(75) Inventor: Wiestaw Kramski, Birkenfeld (DE)

(73) Assignee: Kramski GmbH, Pforzheim (DE)

( * ) Notice: Subject to any disclaimer, the term of this patent is extended or adjusted under 35 U.S.C. 154(b) by 0 days.

(21) Appl. No.: 10/382,665

(22) Filed: Mar. 6, 2003

(65) Prior Publication Data

US 2003/0170481 A1 Sep. 11, 2003

(30) Foreign Application Priority Data

Mar. 6, 2002 (DE) ..... 102 09 715

(51) Int. Cl.[7] ..... H01R 43/16

(52) U.S. Cl. ..... 428/573; 428/600; 439/885; 29/874

(58) Field of Search ..... 428/600, 571, 428/572, 573, 574; 439/180, 885; 29/884, 874

(56) References Cited

U.S. PATENT DOCUMENTS

| | | | | | |
|---|---|---|---|---|---|
| 4,850,905 | A | * | 7/1989 | Capp et al. | 439/885 |
| 5,957,739 | A | * | 9/1999 | Bianca et al. | 439/885 |
| 6,206,735 | B1 | * | 3/2001 | Zanolli | 439/736 |
| 2002/0098746 | A1 | * | 7/2002 | Costa | 439/885 |

FOREIGN PATENT DOCUMENTS

| | | |
|---|---|---|
| EP | 0219935 | 8/1986 |
| JP | 54071385 | 6/1979 |

* cited by examiner

*Primary Examiner*—John J. Zimmerman
(74) *Attorney, Agent, or Firm*—Volpe and Koenig, P.C.

(57) ABSTRACT

A method of production and/or processing of contact elements for electrical plug connectors is provided. The contact elements are fixed to a transport strip during the production and/or processing process. This transport strip is reduced in its material thickness after at least a portion of the production and/or processing process by deformation between the fixed positions of adjacent contact elements on the strip, so that the spacing between the fixed positions of adjacent contact elements is increased.

15 Claims, 1 Drawing Sheet

METHOD FOR PRODUCTION AND/OR PROCESSING OF PLUG PARTS IN FOLLOW-ON COMPOSITE TOOLS

BACKGROUND

The invention relates to a method for the production and/or processing of parts in follow-on composite tools and in particular of contact elements such as contact pins, contact springs and the like for electronic plugs in which the parts are fixed on a transport strip during the production and/or processing process and are forwarded and manipulated in common via the transport strip within a respective process step by the respective tool and/or forwarded and manipulated in common from process step to process step. It is usual in the production of contact springs for electrical plug connectors to leave the springs in usually integral connection with a transport strip during the production process, that is, during their conversion to the required form by stamping, embossing and bending, during the subsequent electroplating, and also during transportation to customers, packaging operations, etc., the detaching or separation of the parts from the transport strip first taking place, as a rule, at the customer. Transport strips also find application during the production of so-called free-dropping parts, which are detached and separated from the transport strip just before delivery to the customer.

The pitch of the transport strip, that is, the spacing between the mid-axes of adjacent parts to be processed, is admittedly not directly standardized; however, transport strips with well-defined pitches are used as a rule, so that these can be handled without problems by the customer. Usual pitches are, for example, 2.54 mm and multiples thereof. Also to be considered besides the pitch is that two adjacent parts must have a specific minimum spacing (for example, half to one and a half sheet metal thicknesses) for manufacturing reasons. This minimum spacing also affects production costs, on the other hand: since a greater spacing of course means more material which has to be rejected as waste after the parts have been stamped out. Since, apart from this, the costs of electroplating, which an electroplating plant charges to its customers, are calculated in particular on the length of the material to be electroplated and thus on the running length of the transport strip, the costs are greater—for an equal surface of material—the greater the spacing between two parts, and thus, in other words, the more is counted for electroplating not in fact carried out of the free spaces between two adjacent parts.

SUMMARY

The present invention has as its object to make the process for the production and/or processing of parts in follow-on composite tools more economical with respect to material used and electroplating costs.

This object is attained according to the invention in that the transport strip is reduced in its material thickness by deformation at least in the region between the positions of two adjacent parts on the transport strip, so that the spacing between two adjacent parts is increased.

The advantage results from this that the parts to be processed are arranged as close together as possible on the transport strip, in order thereby to reduce the length of the transport strip and thereby in particular to be able to reduce the material costs and electroplating costs. Since however the parts have to have a specific minimum spacing and a specific pitch during further processing or when being delivered to a customer, after electroplating the transport strip can be brought by deformation, such as rolling, embossing and the like, to the required (predetermined by the customer) spacing or length measurement. In other words, the spacings between two parts are appropriately kept as small as possible, for reduction of the material and electroplating costs, and are brought to the required spacing measurement after at least a portion of the production and/or processing process, and in particular only after electroplating, in that the transport strip is extended in its length by embossing, rolling or similar deformations.

The material thicknesses of the transport strip can be considerably reduced by such deformation, and correspondingly the spacing between the setting positions of adjacent parts can be markedly increased (in exemplary cases, by about twenty percent). Thus a correspondingly clear saving is obtained, relating to the material costs due to the reduced use weight of the stamping material, and with respect to the electroplating costs, which are calculated based on the running length of the transport strip.

In connection with this, it is particularly desirable that by the deformation, not only is the parts spacing increased, but also the pitch of the transport strip is thereby increased by a specific amount, corresponding to the customer's requirements, in order to be able to further process the parts together with the transport strip. This pitch after deformation is appropriately, e.g., 2.54 mm or multiples thereof Since the deformation of the transport strip is also performed with a view to reducing the electroplating costs, it is recommended to perform the deformation directly or indirectly after the process step of electroplating. Likewise it is however also possible for the deformation to first follow at the end of the production and/or processing process, before delivery to the customer.

The present invention extends, not only to the process for the production and/or processing of parts in follow-on composite tools, but also to the process product, namely a transport strip with parts for electrical plug connectors and the like for the handling of plural parts in common during their production and/or processing process, wherein the transport strip is formed of a metal strip on which the parts are fixed in the region of setting positions, in particular by one-piece shaping and or by joining together, and from which the parts stand out laterally. According to the invention, the transport strip is reduced in its material thickness at least in the region between the fixed positions, and the longitudinal distance between the fixed positions of adjacent parts is increased, enabling these advantages to be attained. Also the transport strip itself according to the invention likewise develops the further advantages mentioned hereinabove regarding the production and/or processing process. Accordingly, further advantageous embodiments of the transport strip provide that the deformation takes place after at least a portion of the production and/or processing process of the parts, so that adjacent parts have the smaller spacing during the process steps before deformation. Additionally, the transport strip can have a longitudinal spacing between adjacent contact elements that is increased by order of magnitude of 20 percent by the deformation. Additionally, the spacing defined as a pitch between the mid-axes of adjacent parts can be increased to a fixed measurement, and in particular to 2.54 mm or a multiple thereof.

Finally, the concept of the invention may also be used for saving material, when the strip material from which the transport strip and possibly the parts formed thereon are produced has sections with a reduced material thickness at least in the region functioning as the transport strip. These sections, which appropriately extend over the whole width of the transport strip and likewise can be produced by deformation such as embossing, rolling and the like, reduce the volume and use weight of the strip material in a region which is unimportant for the end product. This "unimportant" region is of course particularly the region of the transport strip, but theoretically also that width region of the strip material from which the parts are later stamped out can be embodied with reduced material thickness, but this would only be in sections which are situated outside the parts and which form discarded waste material when the parts are stamped out.

BRIEF DESCRIPTION OF THE DRAWINGS

Further features and advantages of the present invention will be apparent from the following description of an exemplary embodiment using the drawing, in which.

DETAILED DESCRIPTION OF THE PREFERRED EMBODIMENTS

Figure 1:
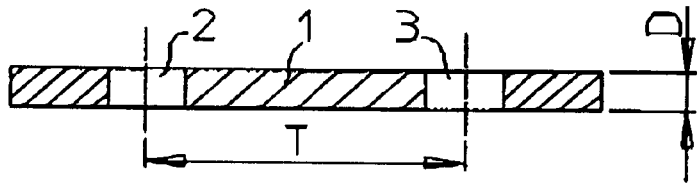
FIG. 1 shows a longitudinal section through a transport strip according to the invention, before the deformation process.
Figure 2:
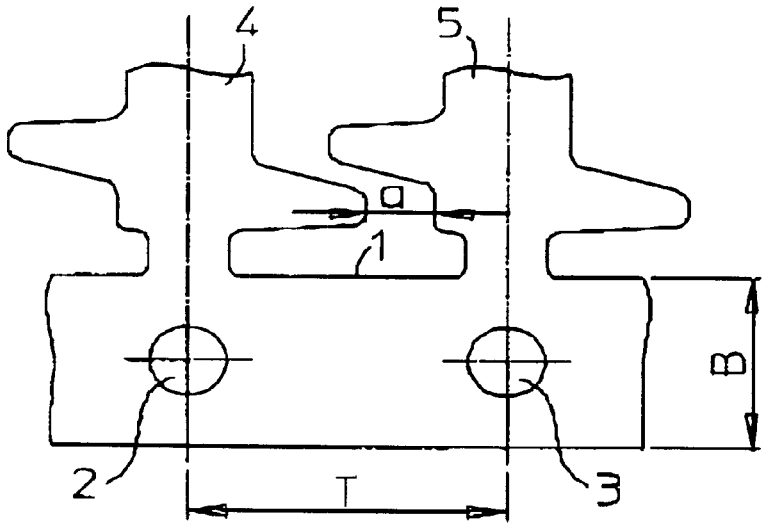
FIG. 2 shows the transport strip of FIG. 1 and in addition plug parts shaped on it, in plan view.

The transport strip 1 shown in FIG. 1 has a material thickness D and a width B and has pilot holes 2, 3 to assist centering when manipulating the transport strip. As can be seen from FIG. 2, the transport strip 1 carries laterally spaced, formed parts 4, 5, integrally connected to the transport strip, for an electrical plug connector. Two adjacent plug parts 4, 5 have a mutual spacing a, which for manufacturing reasons should not fall below a certain minimum amount, for example in order to leave sufficient space for a stamping tool, or not to hinder the processing of the respective adjacent plug parts. The mid-axes of adjacent plug parts 4, 5 have a spacing T, which is termed the pitch.

Figure 3:
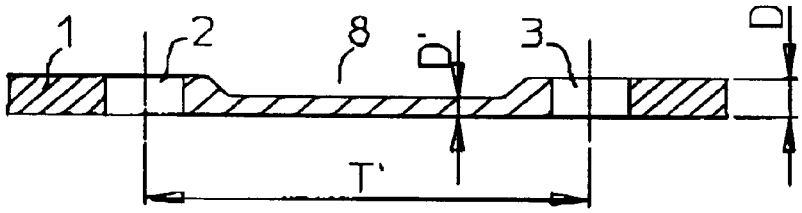
FIG. 3 shows a longitudinal section through the transport strip after the deformation process.
Figure 4:
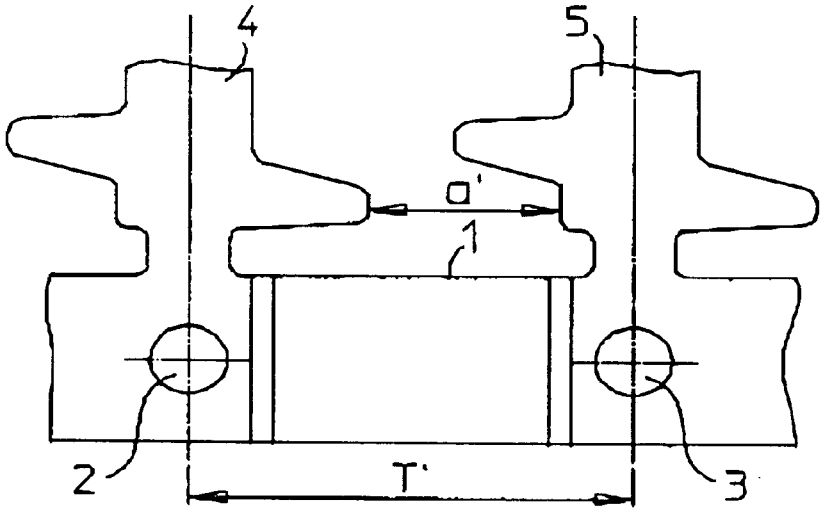
FIG. 4 shows the deformed transport strip of FIG. 3 and in addition plug parts shaped on it, in plan view.

A transport strip is now shown in FIGS. 3 and 4 after a deformation process in the course of which the thickness D of material of the transport strip has been reduced over its whole width B in a region 8 to a thickness D' of material. The transport strip 1 has undergone an extension in the longitudinal direction due to this deformation, so that the pitch T has been increased to a pitch T', and the distance a to a'. With the same number of parts 4, 5 attached to the transport strip 1, the total length of the transport strip is correspondingly lengthened.

If the deformation is performed to an exactly determined extent, the pitch T' after deformation can be made to correspond exactly to the desired pitch. It is thus possible to arrange the plug parts, particularly before stamping the parts out and during an electroplating process, as close together as possible, in order thereby to reduce on the one hand the use weight of the stamping material and on the other hand the running length of the transport strip and thereby the basis of calculation of the electroplating cost, and nevertheless to then be able to produce the pitch and minimum spacing desired or ordered by the customer.

Since the material thickness of the transport strip is as a rule determined by the material thickness of the mostly integrally formed plug parts, and this is however overdimensioned for tension loads which purely become effective during production and processing processes, the function of the transport strip is not impaired if this is brought over its whole width in partial regions, or even over its whole length, to a smaller material thickness.

Summarizing, the advantage of the present invention is that the production and processing process for plug parts can be made cost-effective, without having to incur qualitative losses, since the material thickness of the transport strip has no effect on the end product, as long as the pitch ordered by the customer is adhered to.

What is claimed is:

1. Method for production and/or processing of parts in follow-on composite tools for producing contact elements including contact pins, contact springs and components for electrical plug connectors, the parts (4, 5) being fixed on a transport strip (1) during the production and/or processing process and being forwarded and manipulated in common via the transport strip within a respective process step by a respective tool and/or forwarded and manipulated in common from process step to process step, wherein the transport strip is reduced in material thickness (D) by deformation at least in a region (B) between two adjacent parts (4, 5), so that thereby a spacing (a) between the two adjacent parts is increased.

2. Method according to claim 1, wherein the deformation takes place by at least one of rolling and embossing the transport strip (1) over an entire width (B) thereof.

3. Method according to claim 1, wherein the deformation of the transport strip (1) takes place after at least a portion of the production and/or processing process.

4. Method according to claim 1, wherein a spacing, termed pitch (T), between mid-axes of the two adjacent parts (4, 5) of the transport strip (1) is increased to a defined measurement (T').

5. Method according to claim 4, wherein the pitch (T') is increased by the deformation to approximately 2.54 mm or a multiple of 2.54 mm.

6. Method according to claim 1, wherein the deformation takes place directly or indirectly after a process step of electroplating the parts (4, 5).

7. Method according to claim 1, wherein the deformation takes place only at an end of the production and/or processing process, before delivery to a customer.

8. Transport strip with parts (4, 5) for electrical plug connectors, the transport strip handling plural parts (4, 5) in common during a production and/or processing process, the transport strip (1) comprising a metal strip to which the parts are fixed by integral forming and/or by attachment, and from which the parts stand out laterally, wherein the transport strip (1) is reduced from a thickness (D) of material by deformation, and a longitudinal spacing (a') between adjacent ones of the parts is increased with respect to an original longitudinal spacing (a).

9. Transport strip according to claim 8, wherein the deformation takes place after at least a portion of the production and/or processing process of the parts (4, 5), so that the adjacent parts have the smaller spacing (a) during the process steps before deformation.

10. Transport strip according to claim 8, wherein the longitudinal spacing (a) between adjacent contact elements (4, 5) can be increased in an order of magnitude of 20 percent by the deformation.

11. Transport strip according to claim 8, wherein a spacing defined as a pitch (T) between mid-axes of adjacent parts (4, 5) is increased to a fixed measurement (T').

12. Strip material for use in follow-on composite tool and as a transport strip for production of parts for electrical plug connectors, wherein the strip material has sections with reduced material thickness, at least in a region functioning as a transport strip.

13. Strip material according to claim 12, wherein sections with reduced material thickness extend in a transverse direction of the strip over an entire width of a region functioning as the transport strip.

14. Strip material according to claim 12, wherein the sections with reduced material thickness are produced by deformation.

15. Strip according to claim 14, wherein the deformation is one of rolling and embossing.

* * * * *